US005984323A

United States Patent [19]

Daley

[11] Patent Number: 5,984,323

[45] Date of Patent: Nov. 16, 1999

[54] SYSTEM FOR ACTUATING A SKATE BRAKE

[76] Inventor: Peter A. Daley, 26500 Henderson Park Rd, Oak Creek, Colo. 80467

[21] Appl. No.: 08/841,863

[22] Filed: May 5, 1997

Related U.S. Application Data

[63] Continuation-in-part of application No. 08/382,755, Feb. 2, 1995, abandoned.

[51] Int. Cl.[6] ..... A63C 17/14

[52] U.S. Cl. ..... 280/11.2; 280/11.22

[58] Field of Search ..... 280/11.17, 11.2, 280/11.22, 11.23, 11.27, 11.28, 87.042

[56] References Cited

U.S. PATENT DOCUMENTS

| | | |
|---|---|---|
| 920,848 | 5/1909 | Eubank, Jr. . |
| 926,646 | 6/1909 | Eubank, Jr. . |
| 1,402,010 | 1/1922 | Ormiston . |
| 1,497,224 | 6/1924 | Ormiston . |
| 1,605,985 | 11/1926 | Rasmussen . |
| 2,179,592 | 2/1939 | Goettie . |
| 4,275,895 | 6/1981 | Edwards . |
| 4,458,430 | 7/1984 | Peterson . |
| 4,943,075 | 7/1990 | Gates . |
| 5,171,032 | 12/1992 | Dettmer . |
| 5,211,409 | 5/1993 | Mitchell et al. . |
| 5,226,043 | 7/1993 | Pughe, Jr. et al. . |
| 5,280,930 | 1/1994 | Smathers et al. . |
| 5,312,120 | 5/1994 | Wiegner . |
| 5,320,367 | 6/1994 | Landis . |
| 5,326,325 | 7/1994 | Oetiker . |
| 5,330,207 | 7/1994 | Mitchell . |
| 5,340,131 | 8/1994 | Smathers et al. . |
| 5,351,974 | 10/1994 | Cech . |
| 5,362,076 | 11/1994 | Thomas et al. . |
| 5,415,419 | 5/1995 | Bourgue . |
| 5,430,961 | 7/1995 | Faulconer . |
| 5,464,235 | 11/1995 | Goldman et al. . |
| 5,505,469 | 4/1996 | Zorzi . |

FOREIGN PATENT DOCUMENTS

| | | | |
|---|---|---|---|
| 496056 | 12/1938 | United Kingdom | 36/71 |

*Primary Examiner*—Richard M. Camby
*Attorney, Agent, or Firm*—Hoffman, Wasson & Gitler, P.C.

[57] ABSTRACT

A brake actuator is provided which utilizes fluid as the actuation medium. The fluid is transferred from an activation reservoir through a tube to an expansion chamber which activates the brake. The fluid is contained in a closed system and is biased to a non-braking state so that the wheels will automatically return to their freely rotating state without any further action by the skater after braking. The upper reservoir fits between the liner surrounding the users calf and the back of the skate. The lower reservoir or expansion chamber is positioned adjacent the mechanical braking mechanism. The lower reservoir is biased so that the fluid returns to the upper reservoir and the brake is deactivated. A buffer is provided around the upper reservoir to assure even flow through the reservoir and tube and to create a compressible environment. The buffer helps to prevent inadvertent braking and to provide control of the degree of braking.

21 Claims, 5 Drawing Sheets

SYSTEM FOR ACTUATING A SKATE BRAKE

This application is a continuation-in-part of application Ser. No. 08/382,755 filed on Feb. 2, 1995, now abandoned.

BACKGROUND OF THE INVENTION

1. Field of the Invention

The present invention relates to a device for activating a skate brake. More particularly, the present invention relates to the an activator which contains a fluid, in a closed system, for transmitting an braking impulse to a brake mechanism.

2. Description of the Prior Art

As the popularity of in-line skating has increased, the number of inexperienced skaters has also risen, and that rise has brought with it an increase in the number of injuries. A major cause of injury to inexperienced skaters is the lack of a positive braking mechanism. Experienced skaters have mastered the abilities necessary to stop their skates by dragging a toe, heel or side of the skate. Such an action requires the skater to lift all or a portion of one skate off of the ground, resulting in less stability. Since a less experienced skater wants to maximize his or her stability, an alternative way of braking, not requiring the skater to take a skate off of the ground, is desired.

A number of positive braking devices have been developed to answer this need. For example, U.S. Pat. No. 5,226,673 to Donald Cech discloses a disc braking mechanism for the rear-most wheel of an in-line skate. Similarly, U.S. Pat. No. 5,316,325 shows an in-line skate brake in which a brake shoe is pivotal connected to the rear wheel so that the shoe contacts the ground to thereby create friction and slow the skater. Other patents illustrate brakes where a mechanism is provided for contacting the outside of one or more or the wheels to create friction between the brake and the wheel(s).

In these systems the dragging of a portion of the skate against the ground is replaced by the mechanical, positive brake mechanism. However, the complexity of the foregoing brake systems is a major drawback. The systems require a large number of parts and significant labor to assemble. Both of these factors contribute to an increase in the cost of the skate and the likelihood of failure.

In addition to the brake mechanism itself, each system requires some mechanism for activating the braking system. Some systems are cuff actuated while others utilize hand held devices to transfer air pressure to the brakes thereby activating the brakes. As is the case with the brake, the existing actuators require a significant number of parts and labor. Furthermore, systems employing air pressure need some means to release the air pressure after braking. The more complex the system is the higher the cost of the skate, and the more susceptible the brake is to failure.

While most brake mechanisms are activated by mechanical means, some systems have air pressure activation systems and some form of hand controlled device to develop sufficient air pressure. Such air pressure activated systems, however, have a complicated construction, and there is a delay between the initial activation and braking while air pressure builds to a sufficient level. Furthermore, the system requires some way to release the air after braking.

SUMMARY OF THE INVENTION

The foregoing and other deficiencies of the prior art are addressed by the present invention which is directed to a brake actuation system which utilizes fluid as the actuation medium. The fluid is transferred from an activation reservoir through a tube to an expansion chamber which activates the brake. The activation system can be employed with any braking system.

The fluid is contained in a closed system, eliminating any delay in the braking as exists in open-air pressure systems. The system is biased to a non-braking state so that the wheels will automatically return to their freely rotating state without any further action by the skater after braking, and no air pressure release mechanism will be needed.

The system includes two reservoirs interconnected by a tube. The upper reservoir can fit between the users calf and the back of the skate. Alternatively, the upper reservoir may be positioned between the calf and the back of the skate, between the liner and the shell or built into the cuff when no liner is provided. The lower reservoir or expansion chamber is positioned adjacent the mechanical braking mechanism. The specific configuration of the lower reservoir is determined by the type of brake. The tube interconnects the upper and lower reservoirs to transfer fluid from the upper to the lower during braking thereby activating the brake. Once braking ceases the bias on the lower reservoir forces the system back to its static state and fluid returns to the upper reservoir.

The tube and the two reservoirs can be formed from separate pieces, which can make the assembly process, or retro-fitting, easier, or can be formed from one integral piece.

A buffer is provided around the upper reservoir to assure even flow through the reservoir and tube and to create a compressible environment. The buffer helps to prevent inadvertent braking and to provide control of the degree of braking.

BRIEF DESCRIPTION OF THE DRAWINGS

These and other attributes of the present invention will be described with respect to the following drawings in which.

DETAILED DESCRIPTION OF THE INVENTION

Figure 1:
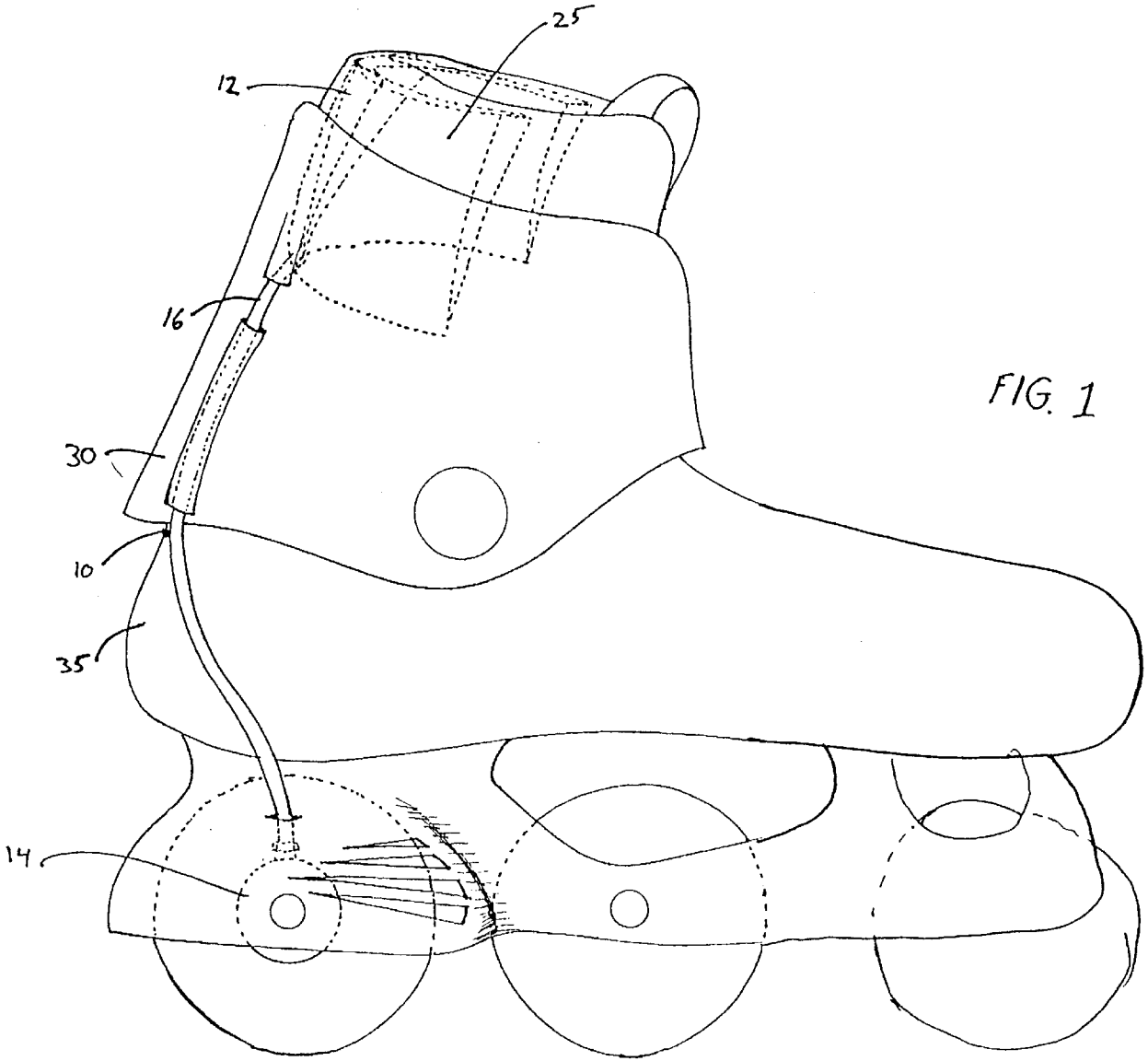
FIG. 1 is a side view of the rear portion of an in-line skate showing the activation system of the present invention with some portions shown in phantom.
Figure 2:
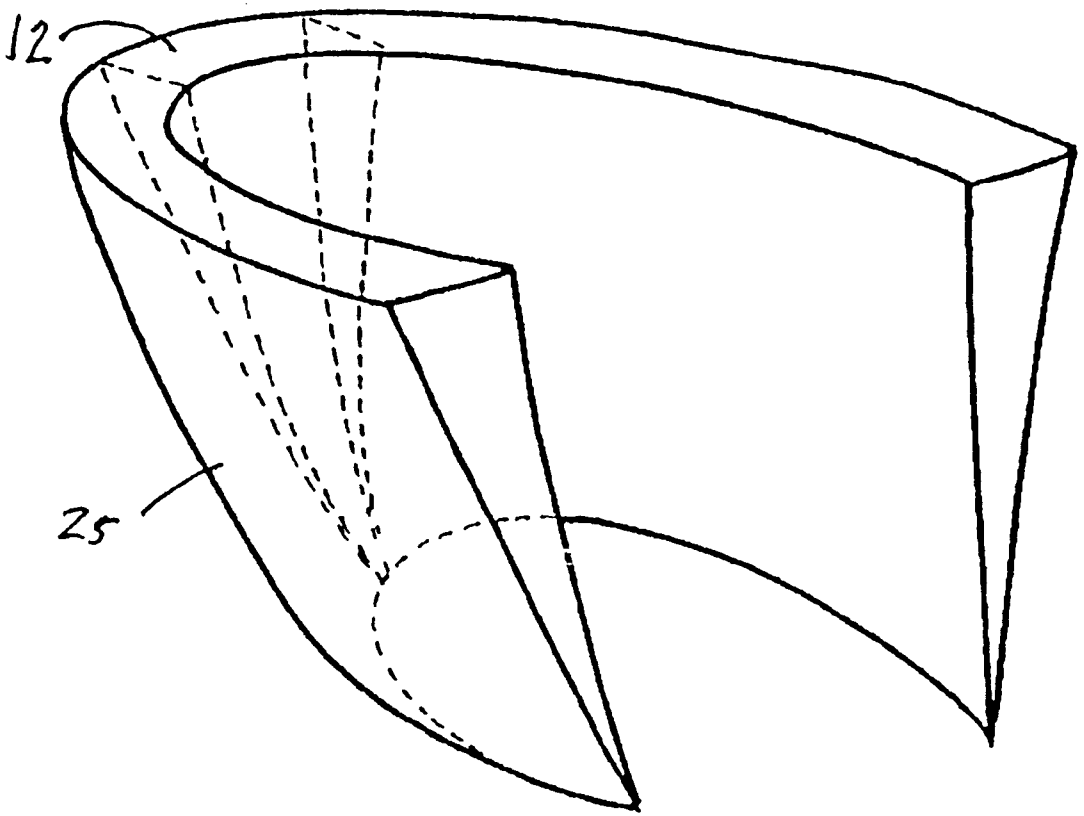
FIG. 2 is a perspective view of a buffer of the present invention with the upper reservoir shown in phantom.
Figure 3:
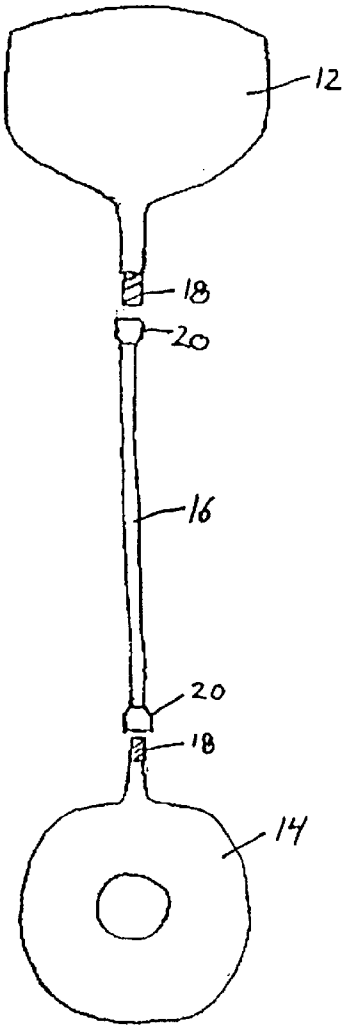
FIG. 3 is a planar view of an upper reservoir, tube and expansion reservoir, made as separate units, according to the present invention.

Referring to FIGS. 1–3, the activation system 10 of the present invention includes an upper reservoir 12, a lower reservoir or expansion chamber 14, and an interconnecting tube 16. The reservoirs 12 and 14 are made from polymeric material which is elastic enough to expand and still maintain its integrity. The tube 16 may be made from the same material as the reservoirs 12 and 14 or a more rigid material, as the tube 16 does not need to expand.

As shown in FIG. 3, the upper reservoir 12, lower reservoir 14, and the tube 16 may be formed as separate parts. In the illustrated embodiment, the upper reservoir 12 and the lower reservoir 14 have external threads 18, which mate with internal threads in the ends 20 of tube 16. By making the reservoirs 12 and 14 and the tube 16 separate parts, the construction of the braking system is facilitated. For example, referring to FIG. 1, the tube 16 is fed inside of the skate cuff 30, outside of the lower boot section 35.

By making the reservoirs 12 and 14 separate from the tube 16, the tube 16 can be worked into position, and the reservoirs subsequently attached. Consequently, such a separate construction makes it possible to retro-fit the brake actuation system of the present invention to existing skates. Alternatively, the reservoirs 12 and 14 and the tube 16 may be integrally formed from the same material, such as by blow molding.

Regardless of whether the tube 16 and the reservoirs 12 and 14 are integral or separate parts, a fluid is contained by these elements to transfer braking force to the brakes. The fluid gas, such as air, liquid or gel. The actuation system 10 is a closed system so that it does not require the release or addition of fluid. If the reservoirs 12 and 14 and the tube 16 are integrally formed, the fluid injected into these elements during the molding process. If three separate parts are employed, the fluid is filled in the assembly process.

As fluid moved from the upper reservoir 12 to lower reservoir 14, the lower reservoir 14 expands so that contact is made with a wheel of the skate or something attached to the wheel of the skate. The hole in the lower reservoir 14 shown in FIG. 3, is provided so that the axle of the wheel fits through. As the lower reservoir 14 expands a brake is forced to come into contact with a wheel rotor. A rubber or other type of braking material, can be attached directly to the lower reservoir 14 to apply pressure directly to the wheel or braking rotor attached to the wheel.

In an actuation system 10 made from separate reservoirs 12 and 14, and tube 16, the system 10 would have to be bleedable for filling a proper amount of fluid during the assembly stage. The upper reservoir 12 would have a valve for bleeding the lines as well as a valve for injecting the fluid.

The size of the reservoirs 12 and 14, and the inner diameter of the tube 16 can be varied to change the reaction time and the performance of the brake actuation system 10.

A cuff buffer 25, shown in FIGS. 1 and 2 is utilized to assure even flow through the upper reservoir 12 and the tube 16, as well as provide consistency in activation. The buffer 25 provides a compressible environment for the upper reservoir 12, and encircles the upper reservoir 12 to create an even compression factor during braking. The buffer 25 helps maintain the proper position of the upper reservoir 12 and assures that any loss of compressive force is minimized. For example, without the buffer 25, the position of the upper reservoir 12 might shift resulting in an uneven application of braking force to the reservoir and a corresponding lack of sufficient braking force transferred to the brake.

In addition, the buffer 25 protects against inadvertent activation of the brake actuation system 10. The buffer 25 is made from compressible material and will not transfer braking force to the reservoir 12 until it is sufficiently compressed. Thus, the compressibility of the buffer 25 provides a degree of safety in that unintended application of force to the upper reservoir 12, will not be transferred to the lower reservoir 14, unless the force exceeds the compressibility of the buffer 25.

In a similar manner the buffer 25 gives the skater the ability to apply a range of braking. If the wearer wishes to slow down, but not stop, the buffer 25 gives the actuation system 10 the ability to transfer a wide range of braking force, instead of an all or nothing option. Thus, the application of pressure to the upper reservoir 12 through the buffer 25 is exact and controllable, providing the user the ability to brake at a desired level.

As shown in FIGS. 1 and 2 the upper reservoir 12 is bellows shaped, which is wider at the top and tapers down to the narrower bottom portion where it meets with the tube 16. The transfer of fluid to the lower reservoir is facilitated by such a construction, however, other shapes can be employed.

The shape of the lower reservoir or expansion chamber 14 depends upon the way the actuation system 10 is employed. For example, for a brake mechanism as taught in U.S. Pat. No. 5,226,673 (Cech) and shown in FIG. 4, the brake pad moves towards the wheel, so the lower reservoir 14 would be shaped so that it expands to push the brake into contact with the wheel. For a brake which contacts the ground, as shown in FIG. 5, and taught in U.S. Pat. No. 5,316,325, the lower expansion reservoir 14 would have cylindrical or round shape so that as it expands, the lower expansion reservoir 14 causes the brake pad to rotate about the wheel axis and contact the ground.

The lower, expansion reservoir 14 is manufactured so that it can expand in one direction or in two opposing directions. The circumference and one side of the lower reservoir 14 can be strengthened during the molding process so that it expands only in the direction of the weakest point, which is the unstrengthened side.

Alternatively, the lower reservoir can be positioned inside of a direction constraint 40, as shown in FIG. 5. The directional constraint 40 surrounds the lower reservoir 14 so that expansion is inhibited in all but one direction.

The upper reservoir 12 contains the fluid in a non-braking state. The upper reservoir 12 is surrounded by resilient buffer 25 which helps to even out the pressure when it is applied. To activate brake, pressure is applied by the user forcing reward pressure on the cuff of the skate. This is done by straightening the leg and sliding the skate forward. The skate has a natural forward pitch so when the rearward pressure is applied on the cuff, the cuff is forced to the end of its rearward movement and stops. As further pressure is applied, the upper reservoir 12, which is positioned at the top rear of the cuff, is pressured and the fluid is moved from the upper reservoir 12 through the line 16. The lower reservoir 14 is forced, by the pressure in line 16, to expand in a direction so as to activate the braking mechanism attached thereto.

Figure 4:
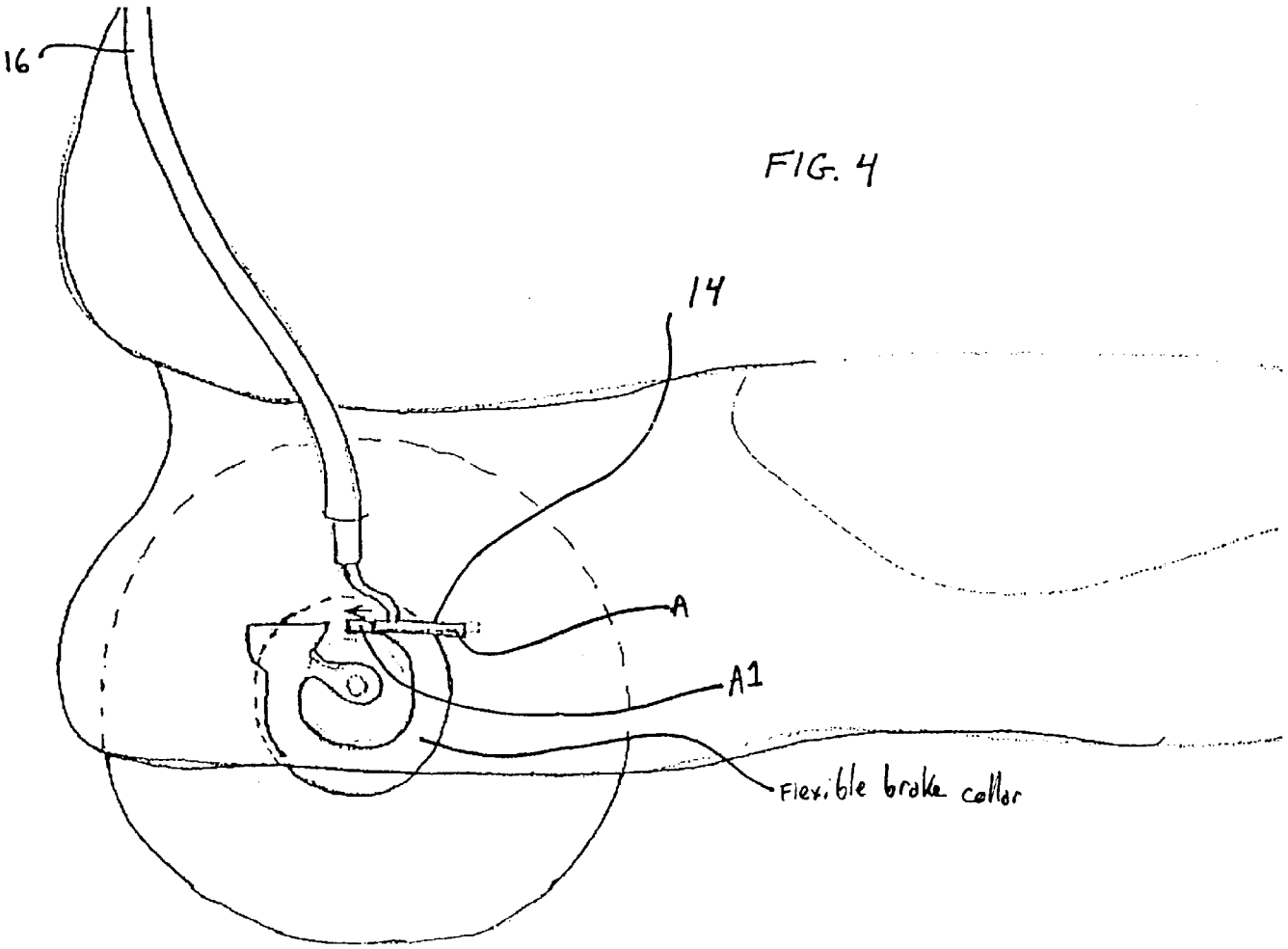
FIG. 4 is a side view of an in-line skate having a wheel contacting brake and an activation system according to the present invention.
Figure 5:
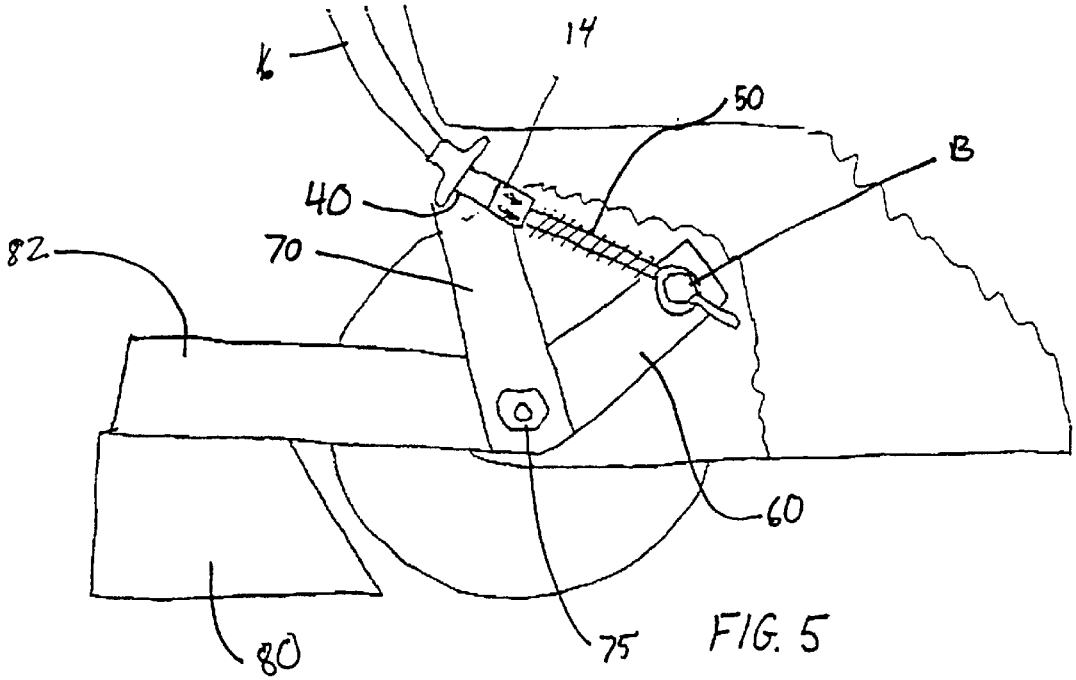
FIG. 5 is a side view of an in-line skate having a ground contacting brake and an activation system according to the present invention.

Referring to FIG. 4, the pressure generated in the upper reservoir, (not shown in FIG. 4) forces the fluid into the lower chamber A. As the pressure builds, the chamber A expands in a rearward direction, to the left in FIG. 4. The expanding piston A1 of the chamber A is connected to the flexible brake collar. As the piston A1 expands, the collar bends and closes around the brake drum and creates friction which starts the braking process. As the buffer 25 surrounding the upper reservoir 12 is depressed further, more force is applied through the line 16, and the piston A1 extends further, resulting in tighter closure around the drum creating more stopping force. The details of the braking mechanism are set forth in U.S. Pat. No. 5,226,673 to Cech.

FIG. 5 shows a similar arrangement, in which pressure is applied from the upper reservoir 12 through the line 16. As pressure is applied, the lower reservoir 14 fills with fluid, which causes it to expand in a rearward direction. The lower reservoir 14 is connected to the braking arm 60, so that as the lower reservoir 14 expands, the braking arm 70 is activated. The end of the lower reservoir 14 is connected to a stationary support at point B at the end of angled section 60. As the lower reservoir 14 expands pressure is exerted on the point B which force the braking arm 70 to pivot counterclockwise as shown in FIG. 5, about pivot 75. As a result the brake stopper 80 and the stopper arm 82 that it is attached to, pivot with the braking arm 70 so that the stopper 80 engages the ground. As more pressure is applied to the upper reservoir 12, the braking force increases due to the corresponding increase in pressure against point b on the angled section 60 which causes the pivot pressure to increase and more force to be applied between the stopper 80 and the ground.

Regardless of the specific construction, the actuation system 10 of the present invention requires a mechanism to bias the reservoirs to the non-braking state. The mechanism or return 50, as shown in FIG. 5, can be a spring mounted so that it offers resistance to the expansion of the lower reservoir 14. When the pressure ceases to be applied to the upper reservoir 12 through the buffer 25, the spring 50, or a return buffer, forces the fluid out of the lower reservoir 14, so that the skate is ready for further activation. While a spring is disclosed in FIG. 5, any device or material which is sufficiently resilient to resist compression and deactivate the brake will work. A support for the spring 50 or other resilient device is required to provide leverage. In FIG. 5 the angled section 60 extending radially from the axle of the wheel acts as such a support.

While the foregoing illustrates some specific braking mechanisms, a key to the present invention is the generation of pressure at the rear of the top of the skate through rearward leg pressure from the user. The pressure is transferred down through the line 16 to initiate movement in a braking mechanism to start the braking process. The degree of braking is controlled by moderating the amount of pressure applied at the top rear of the skate.

Having described an embodiment of the brake actuation system in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A skate brake actuation system comprising;

an upper reservoir, a lower expandable reservoir, a tube connecting said upper reservoir and said lower reservoir, said upper reservoir, said lower expandable reservoir and said tube forming a closed system, a buffer for transferring force to said upper reservoir causing fluid contained in said upper reservoir to move through said tube to said lower expandable reservoir, said buffer being disposed behind the leg of a skater and means for applying pressure to said lower reservoir so said fluid returns to said upper reservoir when said force to said upper reservoir ceases, said lower expandable reservoir being disposed so as to activate a skate brake, wherein said skate brake is activated by application of pressure from said leg of said skater on said buffer causing said fluid to move from said upper reservoir through said tube to expand said lower reservoir, and upon expansion of said lower expandable reservoir causing a brake pad to contact one of a wheel of said skate and a surface on which said skate is riding.

2. A skate brake actuation system as recited in claim 1, wherein said upper reservoir, said tube and said lower expandable reservoir form a closed system for containing said fluid.

3. A skate brake actuation system as recited in claim 1, wherein said buffer surrounds said upper reservoir.

4. A skate brake actuation system as recited in claim 1, wherein said upper reservoir, said tube and said lower expandable reservoir are formed integrally.

5. A skate brake actuation system as recited in claim 1, wherein said fluid is a liquid.

6. A skate brake actuation system as recited in claim 1, wherein said fluid is a gas.

7. A skate brake actuation system as recited in claim 1, wherein said fluid is a gel.

8. A skate brake actuation system as recited in claim 1, wherein said lower expandable reservoir expands in at least one or two directions.

9. A skate brake actuation system as recited in claim 1, wherein said lower expandable reservoir is formed so that at least one side is weaker than all other parts of said lower expandable reservoir, so that said lower expandable reservoir expands towards said at least one weaker side.

10. A skate brake actuation system as recited in claim 9, wherein said lower expandable reservoir is disposed in a directional constraint so that expansion of said lower expandable reservoir is isolated to at least one desired direction.

11. A skate brake actuation system as recited in claim 1, wherein said means for applying pressure to said lower expandable reservoir is a spring.

12. A skate brake actuation system as recited in claim 11, further comprising means for supporting said spring so that said spring forces said fluid to return to said upper reservoir when said force to said upper reservoir ceases.

13. A skate brake actuation system as recited in claim 1, wherein said skate brake is a ground contacting brake.

14. A skate brake actuation system as recited in claim 1, wherein said skate brake is a disc brake.

15. A skate brake actuation system as recited in claim 1, wherein said upper reservoir is wider at an upper edge and tapers downward to a narrower edge where it connects to said tube.

16. A skate brake actuation system as recited in claim 1, wherein said means for applying pressure to said lower expandable reservoir is a resilient buffer.

17. A skate brake actuation system comprising:

an upper reservoir, a lower expandable reservoir capable of expanding in at least one direction, a tube connecting said upper reservoir and said lower reservoir, a resilient buffer, positioned between a liner surrounding a skater's ankle and a cuff of a skate and surrounding said upper reservoir, for transferring force to said upper reservoir causing fluid contained in said upper reservoir to move through said tube to said lower expandable reservoir, a spring for applying pressure to said lower reservoir, and means for supporting said spring so that said spring forces said fluid to return to said upper reservoir when said force to said upper reservoir ceases, said lower expandable reservoir being disposed so as to activate a skate brake upon expansion of said lower expandable reservoir in said one direction, wherein skate brake is activated by application of pressure from said leg of said skater on said buffer causing said fluid to move from said upper reservoir through said tube to expand said lower reservoir, and expansion of said lower expandable reservoir causing a brake pad to contact one of a wheel of said skate and a surface on which said skate is riding.

18. A skate brake actuation system as recited in claim 17, wherein said upper reservoir is wider at an upper edge and tapers downward to a narrower edge where it connects to said tube.

19. A skate brake actuation system as recited in claim 16, wherein said buffer is disposed at a top of a skate cuff.

20. A skate brake actuation system as recited in claim 16, wherein said buffer is disposed between a liner and a cuff of said skate.

21. A skate brake actuation system as recited in claim 16, wherein said buffer is built internally in said skate.

* * * * *